US009556756B2

(12) United States Patent
Zouboff et al.

(10) Patent No.: US 9,556,756 B2
(45) Date of Patent: Jan. 31, 2017

(54) METHOD FOR ESTIMATING THE ANGULAR POSITION OF A CRANKSHAFT FOR ACCELERATING THE STARTING OF AN INTERNAL COMBUSTION ENGINE

(71) Applicants: CONTINENTAL AUTOMOTIVE FRANCE, Toulouse (FR); CONTINENTAL AUTOMOTIVE GmbH, Hannover (DE)

(72) Inventors: Pierre Zouboff, Toulouse (FR); Julien Lefevre, Toulouse (FR); Christophe Mazenc, Toulouse (FR)

(73) Assignees: CONTINENTAL AUTOMOTIVE FRANCE, Toulouse (FR); CONTINENTAL AUTOMOTIVE GMBH, Hannover (DE)

( * ) Notice: Subject to any disclaimer, the term of this patent is extended or adjusted under 35 U.S.C. 154(b) by 324 days.

(21) Appl. No.: 14/244,154

(22) Filed: Apr. 3, 2014

(65) Prior Publication Data

US 2014/0299080 A1 Oct. 9, 2014

(30) Foreign Application Priority Data

Apr. 4, 2013 (FR) ..... 13 53041

(51) Int. Cl.
*F02D 41/00* (2006.01)
*F01L 1/34* (2006.01)
(Continued)

(52) U.S. Cl.
CPC ..... *F01L 1/34* (2013.01); *F02D 41/009* (2013.01); *F02D 41/062* (2013.01); *F02D 41/263* (2013.01); *F02D 2041/0092* (2013.01)

(58) Field of Classification Search
CPC ..... F01L 1/34; F02D 41/00; F02D 41/009; F02D 41/062; F02D 41/263; F02P 5/00; F02P 7/067
See application file for complete search history.

(56) References Cited

U.S. PATENT DOCUMENTS 5,245,968 A 9/1993 Kolias et al.
6,016,789 A 1/2000 Denz et al.
(Continued)

FOREIGN PATENT DOCUMENTS

DE 196 50 250 6/1998
DE 10 2008 060517 6/2009
DE 10 2010 042533 4/2012

OTHER PUBLICATIONS

French Search Report dated Nov. 8, 2013, corresponding to the Foreign Priority Application No. 1353041.

*Primary Examiner* — Jacob Amick
(74) *Attorney, Agent, or Firm* — Young & Thompson

(57) ABSTRACT

A method for estimating the angular position of a crankshaft of a 4-stroke internal combustion engine prior to synchronization of the engine having a plurality of camshafts provided with a number n of targets (CAM_i) secured respectively to n camshafts, each target defining a plurality of events over one revolution of the camshaft to which it is secured, the crankshaft having a securely attached target (CRK) including a plurality of standard teeth and at least one reference tooth which define a plurality of events over one crankshaft revolution, the method including: estimating a range of plausible positions of the crankshaft prior to synchronization, at a given moment, from events detected on the n camshaft targets, correlated with events detected on the crankshaft target, as corresponding to the shortest angular window that is common to all the members of rank i using the following formula:

(Continued)

$$\text{Pos_Crk_est} = \bigcap_{i=1}^{i=n_CAM} \text{List_event_plaus_CAM_i} + \text{Dist_ang_CRK_since_last_event_CAM_i} + \text{Tolerances_i}$$

16 Claims, 9 Drawing Sheets

(51) Int. Cl.
*F02D 41/06* (2006.01)
*F02D 41/26* (2006.01)

(56) References Cited

U.S. PATENT DOCUMENTS

| | | | |
|---|---|---|---|
| 7,783,411 | B2 | 8/2010 | Asada et al. |
| 2002/0157641 | A1 | 10/2002 | Sakakibara |
| 2009/0150048 | A1 | 6/2009 | Asada et al. |

METHOD FOR ESTIMATING THE ANGULAR POSITION OF A CRANKSHAFT FOR ACCELERATING THE STARTING OF AN INTERNAL COMBUSTION ENGINE

FIELD OF THE INVENTION

The present invention relates to a method for estimating the angular position of a crankshaft of a 4-stroke internal combustion engine prior to synchronization of the engine, said engine comprising at least one cylinder comprising a piston able to move between a top dead center and a bottom dead center, the movement of the piston driving the crankshaft and a plurality of camshafts provided with a number n of targets secured respectively to n camshafts each defining a plurality of events over one revolution of the camshaft, the crankshaft being provided with a securely attached target comprising a plurality of standard teeth and at least one reference tooth for one crankshaft revolution, defining a plurality of events over one crankshaft revolution.

BACKGROUND OF THE INVENTION

The present invention further relates to a method for the accelerated starting of an internal combustion engine, comprising a method of estimating the angular position of a crankshaft of a 4-stroke internal combustion engine prior to synchronization of the engine.

In order to start an internal combustion engine it is necessary to know the position of the crankshaft in order to be able to time the injection of fuel and control ignition within the engine cycle at precisely instants intended by the engine control unit. This knowledge by the engine control unit of the position of the crankshaft is referred to as synchronization. A key problem caused by this synchronization phase is that its completion always requires at least one reference tooth of the target of the crankshaft, which generally has one of these for one revolution of the crankshaft, to be "seen" to go past. What happens is that there cannot be synchronization unless the sensor that monitors the crankshaft target sees this reference tooth go past its beam, which reference tooth, considered in isolation, indicates the position of the crankshaft within the engine cycle to within 360° when the crankshaft has one reference tooth for one revolution of the target which corresponds to one revolution of the crankshaft. Synchronization may, where appropriate, also require one or more fronts of a target associated with a camshaft to be "seen" to go past in order to accelerate this phase which consists in determining the position of the crankshaft, through a combination of the events of the crankshaft target and the events recorded on a camshaft target which, for its part, makes one revolution for every two revolutions of the crankshaft target.

However, even though the position of the ignition point needs to be precise, time can be saved in the starting of the engine if injection is performed earlier than synchronization, more particularly in indirect injection engines where injection is into the inlet manifold, in which engines injection really does take place earlier than ignition for a given cylinder. By way of example, for an indirect injection engine injecting into the inlet manifold, it is necessary to have 360 degrees crank of difference between injection and ignition, which means that, if injection waits until the synchronization phase has been completed, a further 360° are needed before ignition can take place, which implies at least one additional full revolution of the crankshaft before the starting of the engine can be begun, this representing around a further 300 milliseconds.

An overall pre-injection method that offers the possibility of injecting into all of the cylinders on startup before the position of the crankshaft has been determined is known, but such a method has the disadvantage of emitting more pollutants.

SUMMARY OF THE INVENTION

The present invention seeks to alleviate the disadvantages of the prior art and proposes an improved method for estimating the angular position of a crankshaft of a 4-stroke internal combustion engine prior to synchronization of the engine.

The present invention also proposes an improved method for the accelerated starting of an internal combustion engine.

Another objective of the present invention is to allow fuel to be injected before synchronization is complete.

Another objective of the present invention is to estimate approximately the position of the crankshaft with a precision approximately equal to the distance between two consecutive compression top dead centers of two different cylinders.

More specifically, the invention relates to a method for estimating the angular position of a crankshaft of a 4-stroke internal combustion engine prior to synchronization of the engine, said engine comprising at least one cylinder comprising a piston able to move between a top dead center and a bottom dead center, the movement of the piston driving the crankshaft and a plurality of camshafts provided with a number n of targets secured respectively to n camshafts of said plurality of camshafts, each target defining a plurality of events over one revolution of the camshaft to which it is secured, the crankshaft being provided with a securely attached target comprising a plurality of standard teeth and at least one reference tooth which define a plurality of events over one crankshaft revolution, characterized in that the estimating method consists in:

- determining a precision to be achieved in estimating a range of plausible positions of the crankshaft prior to synchronization,
- then estimating a range of plausible positions of the crankshaft prior to synchronization, at a given moment, from events detected on said n camshaft targets, correlated with events detected on the crankshaft target, as corresponding to the shortest angular window that is common to all the members of rank i using the following formula:

$$\text{Pos_Crk_est} = \bigcap_{i=1}^{i=n_CAM} \text{List_event_plaus_CAM_i} + \text{Dist_ang_CRK_since_last_event_CAM_i} + \text{Tolerances_i}$$

where:

Pos_Crk_est=Range of plausible positions of the crankshaft at the given moment;

List_event_plaus_CAM_i=All of the plausible events of the rank i camshaft target (CAM_i) at the given moment;

Dist_ang_CRK_since_last_event_CAM_i=Angular distance covered by the crankshaft, determined by all of the detected events of the crankshaft target since the last event detected on the rank i camshaft target, at the given moment;

Tolerances_i=Angular window of possible positions of the crankshaft, resulting from the angular tolerance on the detection of an event on the rank i camshaft target and the crankshaft target;

n_CAM=Number of camshaft targets used in the engine;

repeating said estimate of a range of plausible positions of the crankshaft prior to synchronization, at a later moment, until said precision that is to be achieved in estimating a range of plausible positions of the crankshaft prior to synchronization is obtained.

An event is considered plausible if it is compatible with the engine control unit database in which the correlated profiles of all the camshaft and crankshaft targets have been recorded beforehand, notably giving a sequence of chains of events detected and times separating these events, which can be quantified using the crankshaft target, modulo one camshaft revolution corresponding to one cycle of the 4-stroke engine. The present invention offers a method which can be suited to any profile and number of camshaft targets, and enjoys multipurpose application to any engine comprising a plurality of camshafts. The method according to the invention uses events detected on the camshaft targets and on the crankshaft target, allowing an estimate at any given moment which can be chosen by the engine control unit. There is no need to detect a camshaft target event in order to make an estimate. Successive estimates of a range of plausible positions of the crankshaft can be made on the basis of a predetermined sequence of estimations. The method according to the invention makes it possible to obtain an estimate of a range of plausible positions of the crankshaft, which estimate is sufficiently precise, in an optimized time, whatever its starting position, using any event detected on the camshaft targets and the crankshaft targets and exploiting the result obtained to maximum effect by correlating the detected events between the targets and by comparing with the correlated profiles of the targets which are recorded in the engine control unit. The method according to the invention can be implemented by an engine control unit of known type, using simple software installed therein.

Advantageously, the movement of the piston driving the crankshaft and at least one first and one second camshaft which are respectively provided with a first securely attached target and a second securely attached target, the method comprises the following steps:

at a first event detected on one of the first and second camshaft targets, recording the events detected on the crankshaft target from the setting-in-rotation thereof, defining a first correlation assigned to said first event, eliminating those events on said one of the first and second camshaft targets which from the first correlation cannot be plausible, and determining a first set of ranges of plausible positions of the crankshaft as being made up of a first set of events that remain plausible on said one of the first and second camshaft targets at the end of the first event detected, at a second event, subsequent to the first event, detected on one of the first and second camshaft targets, recording the events detected on the crankshaft target between said first and second events detected, defining a second correlation assigned to said second event, eliminating those events on said one of the first and second camshaft targets which from said second correlation cannot be plausible, and determining a second set of ranges of plausible positions of the crankshaft as being made up of a second set of events that remain plausible on said one of the first and second camshaft targets at the end of the second event detected, determining a third set of ranges of plausible positions of the crankshaft as being made up of the ranges of plausible positions that are common to said first and second sets of events that remain plausible on the first and/or second camshaft targets at the end of the first and second events detected, determining a fourth set of ranges of plausible positions of the crankshaft as being made up of said third set of ranges of plausible positions of the crankshaft from which have been eliminated those positions that are not plausible at the end of a first correlation between, on the one hand, said first and second events detected on one and/or the other of the camshaft targets and, on the other hand, the angular distance given by the events detected on the target between these said first and second events detected on one and/or the other of the camshaft targets, repeating the preceding steps until an nth set of ranges of plausible positions of the crankshaft containing a single plausible range of crankshaft positions is obtained.

Advantageously, the method according to the invention further consists in determining an intermediate set of ranges of plausible positions of the crankshaft, at a current position thereof, between two successive events of the first and/or second camshaft targets, from a correlation between the last event detected on one of the camshaft targets and said current position of the crankshaft, taking into consideration the crankshaft target events detected between said last event and said current position of the crankshaft.

Advantageously, said plurality of events for a target which is determined over one revolution of a camshaft takes into account a selective parameter of distance to the axis of the target, for a surface connecting two successive distinct fronts of the target.

Advantageously, a record is made of the situation of the n camshaft targets at the time the crankshaft is set in rotation.

The invention further relates to a method for the accelerated starting of an internal combustion engine, characterized in that it comprises a method of estimating the angular position of a crankshaft of a 4-stroke internal combustion engine prior to synchronization of the engine, as defined above according to the invention, in order to inject the fuel before synchronization is complete.

The invention further relates to a device for estimating the angular position of a crankshaft of a 4-stroke internal combustion engine prior to synchronization of the engine, said engine comprising at least one cylinder comprising a piston that can move between a top dead center and a bottom dead center, the movement of the piston driving the crankshaft and a plurality of camshafts, the device comprising:

a number n of targets respectively secured to n camshafts of said plurality of camshafts, each target defining a plurality of events over one revolution of the camshaft to which it is secured, a target secured to the crankshaft, comprising a plurality of standard teeth and at least one reference tooth which define a plurality of events over one crankshaft revolution, an engine control unit, characterized in that the engine control unit comprises the means necessary for implementing a method according to the invention for estimating the angular position of a crankshaft of a 4-stroke internal combustion engine prior to synchronization of the engine.

According to one advantageous feature, the device according to the invention comprises fuel injection means, and is characterized in that the engine control unit further comprises the means necessary for implementing a method according to the invention for the accelerated starting of an internal combustion engine involving a step of injecting the fuel before synchronization is complete.

BRIEF DESCRIPTION OF THE DRAWINGS

Further features will become apparent from reading the following examples of embodiments of a method according to the invention, accompanied by the attached drawings, which examples are given by way of nonlimiting illustration.

DETAILED DESCRIPTION OF THE INVENTION

Figure 1:
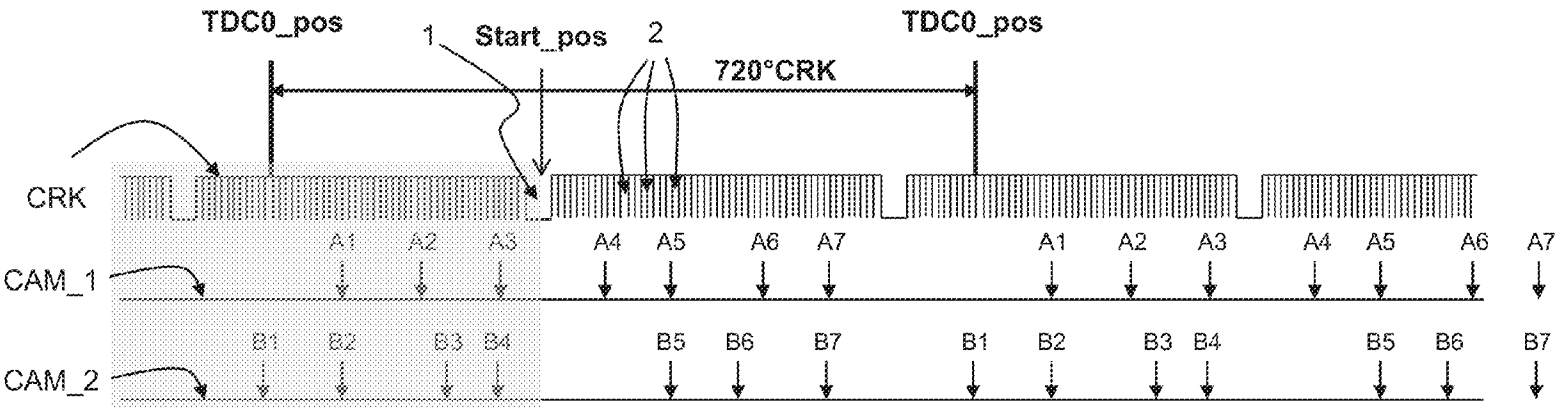
FIGS. 1 to 5 respectively depict five schematic steps in a first example of an embodiment of a method for estimating the angular position of a crankshaft of a 4-stroke internal combustion engine prior to synchronization of the engine.

The first example will now be described with the aid of FIGS. 1 to 6. The engine (not depicted) is equipped in the known way with two camshaft targets CAM_1 and CAM_2 on two different camshafts, and with a crankshaft target CRK, so n_CAM=2, and with the corresponding sensors, also known, for exploiting these targets.

Each FIGS. 1 to 6 represents, on three separate horizontal lines, as a development, the respective events that constitute the two targets CAM_1 and CAM_2 and the target CRK of the crankshaft. The events of the three targets CAM_1, CAM_2 and CRK are depicted in synchronization in the vertical direction in each figure. That means that whatever the position of a vertical index consisting of a segment of vertical straight line, positioned at some point along the development of the targets CAM_1, CAM_2 and CRK, this index defining a given moment or given engine position, it shows the comparative position of the three targets for this moment at the point where the index intercepts the three lines of the three targets. To the right and to the left of an index in each figure are situated, respectively, the forthcoming or past events for each target, the index sweeping from left to right in the figures as the crankshaft rotates, to illustrate the movement of the targets and the passage of the events that they comprise past their respective detector beam. In the figures, the pale gray zone situated to the left of the index Start_pos indicates a zone which is not taken into consideration for the starting of the engine (direction of rotation that is the opposite to the direction of rotation of the crankshaft).

It should be noted that the target CRK comprises one reference tooth 1 for one revolution thereof or of the crankshaft. This reference tooth 1 is symbolized as a long tooth (absence of one or more teeth) and is represented by a square wave on the horizontal line of the target CRK. Between the square waves are represented a plurality of vertical hatchings 2 schematically symbolizing the teeth of the target CRK, of which there are for example 34. It can be seen in FIGS. 1 to 6 that the target CRK has been depicted in development over a little more than three crankshaft revolutions, so four reference teeth have therefore been depicted.

The two targets CAM_1 and CAM_2 for their part have been depicted accordingly for approximately two revolutions. The references Ai, where i adopts the value from 1 to 7, depict the developed angular position of the seven events that the target CAM_1 comprises, each indicated in the form of an index arrow pointing to the target line. The references Bi, i adopting the value from 1 to 7, indicates the developed angular position of the seven events that the target CAM_2 comprises, likewise each depicted in the form of an index arrow pointing to the target line. In FIGS. 1 to 6, the angular position between two successive events of a target is illustrated by the linear distance separating said two successive events on the target. Events Ai and Bi in the example are the rising or falling fronts of the target that the respective beams of the sensors encounter as the targets rotate. It will be noted that the same events are thus depicted twice for each target CAM_1 and CAM_2, corresponding to the more or less two revolutions of the targets depicted, as indicated earlier. The example depicted in FIGS. 1 to 6 does not take into consideration for the targets CAM_1 or CAM_2 any additional selective parameter of distance to the axis of the target, for a surface connecting two successive distinct fronts of the target.

Each FIGS. 1 to 5 depicts with vertical arrows pointing downward (crankshaft target) or upward (camshaft targets) the current position of the position of the crankshaft at which an estimate is made of a set of ranges of plausible positions of the crankshaft prior to synchronization, and the events detected during the rotation of the crankshaft from a starting position. Each FIGS. 1 to 5 shows the most recent event detected and a corresponding estimate of a set of ranges of plausible positions of the crankshaft, together with the earlier events detected since the start of rotation of the crankshaft. The final FIG. 6 illustrates an overview of the successively estimated ranges of plausible positions of the crankshaft prior to synchronization.

FIGS. 1 to 6 also indicate, using two parallel vertical indexes TDC0_pos, the positions of two compression top dead centers. An engine cycle therefore extends between these two TDC0_pos indexes, over a rotation of 720° of the crankshaft.

In FIGS. 1 to 6, the starting position of the crankshaft at the instant it starts to be rotated, for example by an electric starter motor, has been indicated using a vertical index pointing toward the line of the crankshaft target CRK, reference Start_pos. The assumption in this first example is that starting occurs while the beam of the target CRK is placed in the reference tooth 1 of the target. Therefore, it is necessary to wait at least one 360-degree rotation of the crankshaft before synchronization is complete, i.e. before the first reference tooth appears, the starting one not being detected. The description which follows will demonstrate that it will be possible using the method according to the invention to estimate the position of the crankshaft well before this synchronization deadline.

FIGS. 1 to 5 depict the sequence of successive operations in the method described, until a single range of possible positions of the crankshaft has been estimated, which represents the desired degree of precision, for example taking into consideration the measurement tolerance on the detection sensors associated with the targets.

FIG. 6 also depicts, in an added diagram, the time t along an abscissa axis at the bottom of the sheet, and, along the ordinate axis, the position Pos_Crk of the crankshaft from 0 to 720°, estimated or actual, this having been indicated underneath the three separate lines of the three targets CAM_1 and CAM_2 and CRK. The events of the three targets CAM_1, CAM_2 and CRK, as well as the estimated position Pos_Crk of the crankshaft are indicated synchronized along the time axis t which is the abscissa axis in this FIG. 6. The estimated positions of the crankshaft are indicated in dark gray zones and the actual position of the crankshaft is indicated as a thick oblique black line.

The example of a method according to FIGS. 1 to 6 will now be described in more detail with steps of how the method is run.

Depending on the number of engine cylinders and on the objective to be achieved, for example injection of fuel into the inlet manifold for indirect injection, or injection into one or more suitable cylinders for direct injection, prior to synchronization of the engine, a precision to be achieved in estimating a range of plausible positions of the crankshaft prior to synchronization needs to be implemented in the engine control unit as explained later on. As soon as this precision on a range of plausible positions of the crankshaft is achieved, the engine control unit can advantageously proceed with injecting fuel prior to synchronization.

FIG. 1 gives the actual position of the engine at the time that rotation of the crankshaft is initiated, with the assumptions and references as explained above, and, as depicted, namely a start with the beam of the sensor of the crankshaft target CRK placed in the reference tooth 1. At this stage, with no CAM_1 or CAM_2 target level available, the set of ranges of plausible positions of the crankshaft is defined by the interval [0; 720°] corresponding to an angular distance of 720°, because all the fronts of targets CAM_1 or CAM_2 are plausible.

Figure 2:
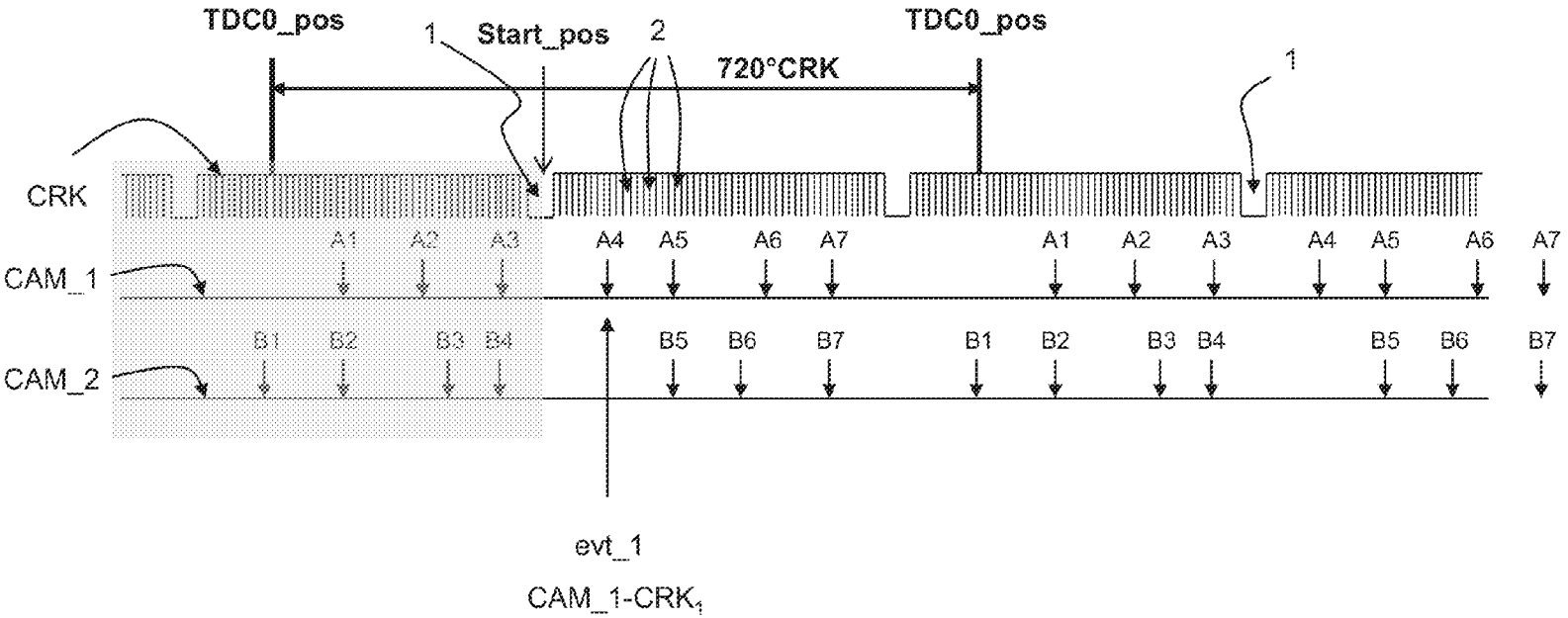

FIG. 2 illustrates detection of a first camshaft target event evt_1 from the setting-in-rotation of the crankshaft. This is the front A4 of the target CAM_1 in the example depicted, of which the identity of the engine control unit is, at this stage, unaware.

Since the start, a certain number of events have occurred on the target CRK, consisting of the detection of the consecutive teeth of the target CRK, defining an angular distance between the starting point Start_pos and the first detected event evt_1. A first correlation CAM_1-$CRK_i$ assigned to this first event evt_1 is thus defined. The test estimation of a set of ranges of plausible positions of the crankshaft at this stage of FIG. 2 provides no information that will allow any potential implausible positions of the crankshaft to be eliminated by comparison with the starting estimate. This is because the angular distance that has elapsed between the starting position Start_pos in FIG. 1 and detection of the first event evt_1 in FIG. 2 is too small to pick out fronts from the set or list of plausible events of the target CAM_1. Indeed this distance is shorter than all the distances separating two successive fronts on the target CAM_1, as indicated schematically in the development of the target CAM_1 in FIGS. 1 to 6. As a result, at this stage, all of the ranges of plausible positions of the crankshaft are thus defined more or less by the interval [0; 720°] or, more specifically, by all of the ranges respectively surrounding the plausible fronts of the target CAM_1, give or take the detection tolerances. According to the formula defined above:

$$\text{Pos_Crk_est} = \bigcap_{i=1}^{i=2} \text{List_event_plaus_CAM_i} + \text{Dist_ang_CRK_since_last_event_CAM_i} + \text{Tolerances_i}$$

a first set of ranges of plausible positions of the crankshaft, at the end of detection of the first event evt_1, is thus made up of the following first set of events that remain plausible on the first camshaft target CAM_1, give or take the detection tolerances of the target concerned:

$$[A1, A2, A3, A4, A5, A6, A7] +/- \text{Tolerances}$$

What is meant by a range of positions is all the plausible positions of the crankshaft in the range considered, comprising positions that are plausible on account of the detection tolerances.

For example, the formula above is equivalent to the following formula:

$$[A1 - \text{tolerances}, A1 + \text{tolerances}] \cup [A2 - \text{tolerances}, A2 + \text{tolerances}] \cup [A3 - \text{tolerances}, A3 + \text{tolerances}] \cup [A4 - \text{tolerances}, A4 + \text{tolerances}] \cup [A5 - \text{tolerances}, A5 + \text{tolerances}] \cup [A6 - \text{tolerances}, A6 + \text{tolerances}] \cup [A7 - \text{tolerances}, A7 + \text{tolerances}]$$

This equivalence in writing applies to the whole of the present description, in a way specific to each set of events considered.

Figure 3:
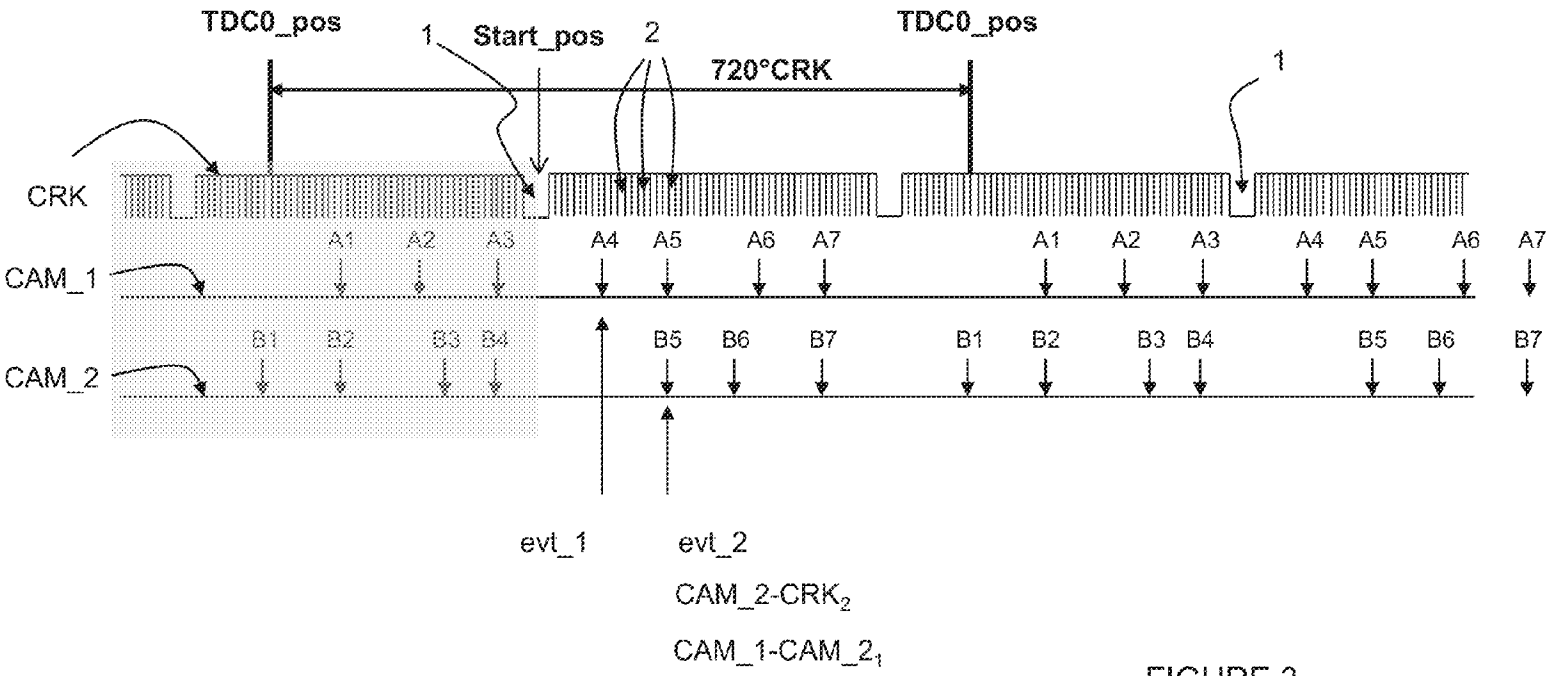

FIG. 3 illustrates the detection of a second event evt_2 on a camshaft target, subsequent to the first event evt_1 described hereinabove. This is the front B5 of the target CAM_2 of which the engine control unit is likewise at this stage unaware of the identity, synchronization having not yet taken place. Since the first event evt_1, a certain number of events have occurred on the target CRK, consisting of the detection of the teeth of the target CRK, defining an angular distance between the first event evt_1 detected in FIG. 2 and the second event evt_2 detected in FIG. 3. The test on estimating a second set of ranges of plausible positions of the crankshaft at this stage in FIG. 3 provides information that allows ranges of crankshaft positions which are no longer plausible because of the detection of the second event evt_2 to be eliminated. Indeed, as FIG. 3 shows, the angular distance that has been covered between the starting point Start_pos and the second event evt_2 on the target CAM_2 is compatible with all the fronts of this target CAM_2 except the front B4, taking detection tolerances into consideration. A second correlation CAM_2-$CRK_2$ assigned to this second event evt_2 is obtained and this leads to a second set of ranges of plausible positions of the crankshaft which is made up of a set of plausible events that remain on the second camshaft target CAM_2, as follows, give or take the detection tolerances of the target concerned:

$$[B1, B2, B3, B5, B6, B7] +/- \text{Tolerances}$$

A third set of ranges or plausible positions of the crankshaft is then defined as being made up of the ranges common to the first and second sets of ranges of plausible positions of the crankshaft as defined above, give or take the detection tolerances, as follows:

$$[B1,B2,B3,B5,B6,B7] \cap [A1,A2,A3,A4,A5,A6,A7] +/- \text{Tolerances}$$

A first test on the correlation CAM_1-CAM_$2_1$ between the first event evt_1 and the subsequent second event evt_2 which consists in comparing the angular distance that has elapsed between these two events, measured by means of the events of the target CRK which have been detected between these events evt_1 and evt_2 of the camshaft targets, makes it possible to pronounce that this distance is compatible only with the angular distance separating the fronts A4 and B5 of course, but also with the angular distance separating the fronts A6 and B7. Bearing in mind this correlation CAM_1-CAM_$2_1$, a fourth set of ranges of plausible positions of the crankshaft can be established as being made up of the third set of ranges of plausible positions of the crankshaft as defined hereinabove, reduced to the following set of ranges of plausible positions:

[B5,B7]+/−Tolerances

From the estimate obtained hereinabove of plausible ranges of the crankshaft, and from the topology of the targets CAM_1, CAM_2, and CRK as recorded in the engine control unit, it is possible to deduce, in the example depicted in FIGS. 1 to 6, that the next event, i.e. the third event, to be detected, will be an event on the camshaft target CAM_1, namely the front A5 or the front A7.

Figure 4:
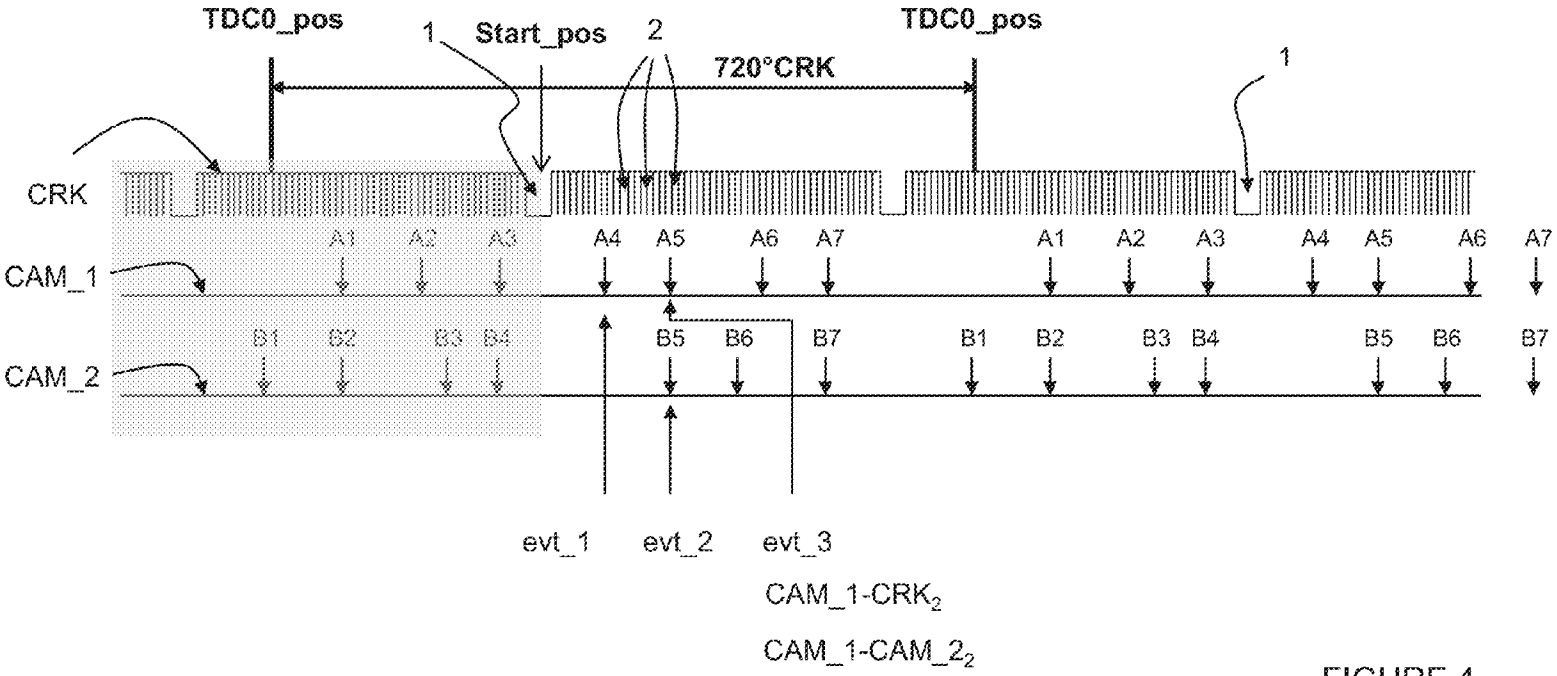

FIG. 4 therefore illustrates detection of the third event evt_3, subsequent to the first two evt_1 and evt_2. This third event evt_3 is the detection of the front A5 on the target CAM_1. At this stage, the engine control unit is unaware of whether this is the front A5, and has a choice of identification between the fronts A5 or A7 of this target. A correlation CAM_1-$CRK_2$ of this third event evt_3 with the first event evt_1 detected on the target CAM_1, by means of the events of the target CRK which are detected between the two events evt_1 and evt_3 of the camshaft targets is of no help, because the angular distance between the fronts A4 and A5 is similar to the angular distance between the fronts A6 and A7, and the third event evt_3 detected could therefore be the front A7 on the basis of such a correlation. The estimation of the range of plausible positions of the crankshaft at the end of this correlation CAM_1-$CRK_2$ is therefore as follows, which is unchanged from the previous one:

[B5,B7]∩[A5A7]+/−Tolerances

With the detection of the third event evt_3, a second correlation CAM_1-CAM_$2_2$ between the events detected on the camshaft targets teaches that the angular distance between the second event evt_2 and the third event evt_3 is compatible with the angular distance between the fronts A5 and B5 on the one hand, and between the fronts A7 and B7 on the other hand. Therefore this correlation provides no additional detail which might perhaps have allowed ranges of positions that had become implausible to be eliminated from the fourth set of ranges of plausible positions of the crankshaft. The estimation of the range of plausible positioned of the crankshaft at the end of this correlation CAM_1-CAM_$2_2$ is therefore as follows, unchanged from the previous one:

[B5,B7]∩[A5,A7]+/−Tolerances

Figure 5:
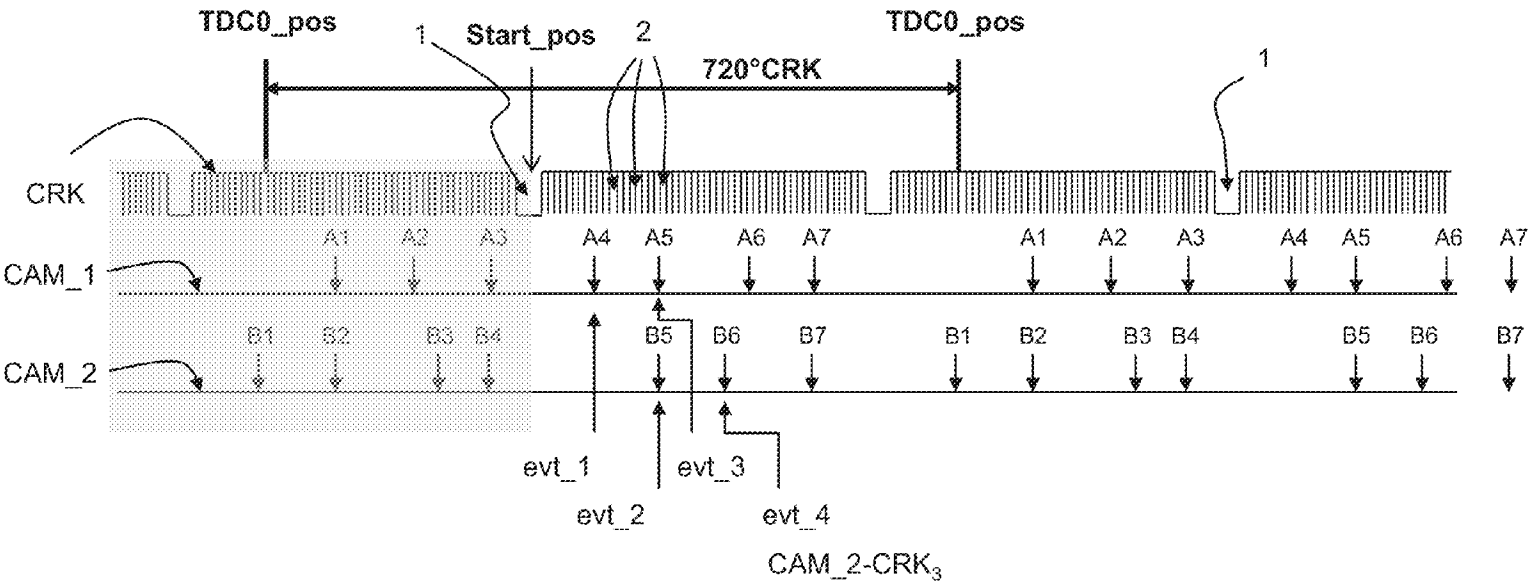
Figure 6:
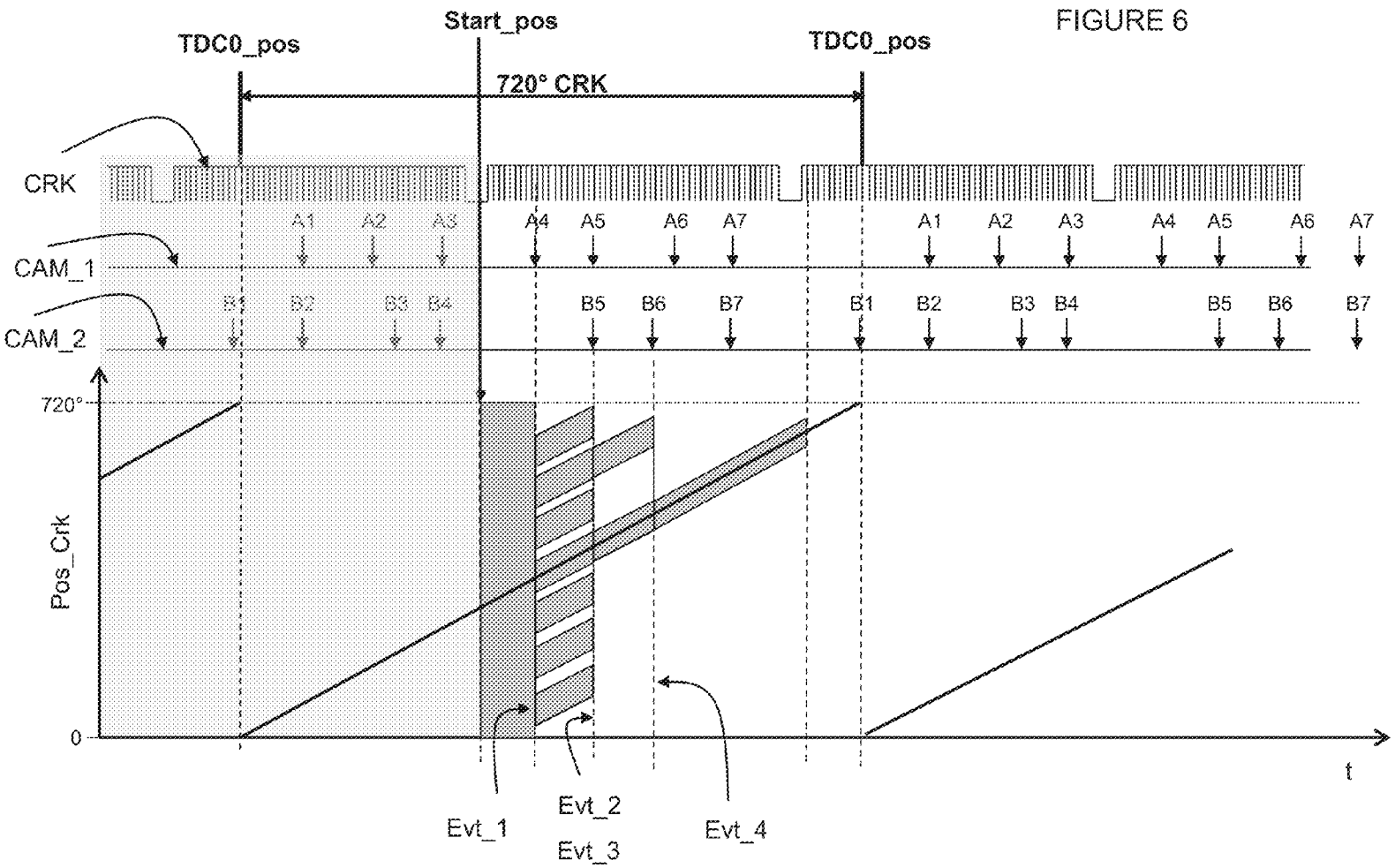
FIG. 6 is a schematic overview which combines FIGS. 1 to 5, FIGS. 7 and 8 respectively depict two schematic steps in a second example of an embodiment of a method for estimating the angular position of a crankshaft of a 4-stroke internal combustion engine prior to synchronization of the engine.

FIG. 5 illustrates the detection of a fourth event evt_4, subsequent to the previous ones. This fourth event evt_4 is the detection of the front B6 on the target CAM_2, in the example depicted. At this stage, the engine control unit is still unaware that this is the front B6. A correlation CAM_2-$CRK_3$ between the last two events evt_4 and evt_2 detected on the target CAM_2 teaches that the angular distance elapsed between the second event evt_2 and the fourth event evt_4 is compatible only with the angular distance between the fronts B5 and B6, which is unique in the topology of the fronts of the target CAM_2, as depicted in FIGS. 1 to 6. Furthermore, the choice of ranges of crankshaft positions that remain plausible upon detection of this fourth event evt_4 was B5 or B7; now, there are no fronts after B7 at the angular distance separating the two events evt_4 and evt_2 detected on the target CAM_2. Therefore, the only possible choice for the second event evt_2 was B5.

As depicted in FIG. 5, at the end of this fourth event evt_4 detected, there still remains just one single plausible range of crankshaft positions, which is therefore theoretically B6. This range B6 which is in itself represented by a precise discrete front, in actual fact comprises a set of plausible positions around this front, these representing the detection tolerances of the sensor of the target CAM_2, as shown in FIG. 6. Just four events will be needed in order to provide an estimate of the angular position of the crankshaft prior to synchronization of the engine on completion of the determination of a fifth and final set of ranges of plausible positions of the crankshaft containing a single plausible range of positions. In FIG. 5, it will be recalled that engine synchronization could not take place until the reference tooth 1 of the target CRK had been detected for a first time following the setting-in-rotation of the crankshaft. Again in FIG. 5, it can be seen that there were still three events A6, A7 and B7 to be detected on the targets CAM_1 and CAM_2 before this reference tooth 1 of the target CRK is detected.

FIG. 6 illustrates the successive sets of ranges of plausible positions of the crankshaft prior to synchronization for each event evt_1, evt_2, evt_3, evt_4 detected, from the starting position Start_pos the position index of which has been shifted toward the diagram at the bottom of the figure. These plausible positions of the crankshaft Pos_Crk are indicated by dark gray areas evaluated on the ordinate axis over an amplitude of rotation of 720°, and for a duration evaluated on the abscissa axis, the time axis, between two successive events.

For example, between the starting position Start_pos and the first event evt_1, the set of the ranges of plausible positions of the crankshaft is defined by the interval [0; 720° ] on the ordinate axis, this evaluation remaining valid until the next estimate, in this example the next event: the surface is therefore shaded dark gray over 720° and over a time separating the start Start_pos from the first event evt_1 detected.

From the first event evt_1 detected onwards, the dark gray area is reduced to all of the ranges of possible positions about each plausible front of the target CAM_1, namely A1, A2, A3, A4, A5, A6, A7, to within the detection tolerances, as explained in detail above, and this is illustrated in FIG. 6 by seven corresponding dark gray oblique stripes between the events evt_1 and evt_2.

From the third event evt_3 detected, the set of ranges of plausible positions of the crankshaft prior to synchronization has been reduced to the ranges A5 and A7, give or take the detection tolerances, and this is illustrated in FIG. 6 by two oblique stripes between the events evt_3 and evt_4, which stripes align with the dark gray ranges between the events evt_1 and evt_2 and correspond to events A5 and A7. Between the events evt_3 and evt_4, the estimated position of the crankshaft is thus known in the example in a range of angular distance of the order of 200° evaluated along the ordinate axis, which distance for example is too great to allow injection prior to synchronization in a four-cylinder engine. Nevertheless, such a relatively broad estimate of the angular position of the crankshaft prior to synchronization would be suitable for a three-cylinder engine in order to inject prior to synchronization.

In FIG. 6, the width of each dark gray oblique stripe between two events illustrates a range of plausible angular positions of the crankshaft in which the event concerned lies, which are rendered possible by the measurement and detection tolerances of the sensors associated with the targets CAM and CRK, for example a tolerance evaluated at plus or minus 20° of true crank angle for the events of the camshaft targets CAM. Let us recall that each thick oblique black line in FIG. 6 represents the exact or true position of the crankshaft.

The position of the crankshaft prior to synchronization will be estimated definitively in the example considered for a four-cylinder engine for example, from the detection of the event evt_4, in a single range of plausible positions, as indicated in FIG. 6 by a single dark gray oblique area from this event evt_4 onwards and as far as the first reference tooth detected on the target CRK, which completes the synchronization of the crankshaft in this example. In FIG. 6, a pre-synchronization injection can be performed from detection of the front B6 identified as such by the engine control unit, as explained above. This allows the engine to be started earlier, a crank angle of the order of 180° earlier, as illustrated in FIG. 6, which represents around 150 milliseconds.

The second example of an embodiment of a method according to the invention will now be described with the aid of FIGS. 7 to 9. The engine (not depicted) is equipped with four camshaft targets CAM_1, CAM_2, CAM_3 and CAM_4, namely n_CAM=4, and with a crankshaft target CRK.

Figure 7:
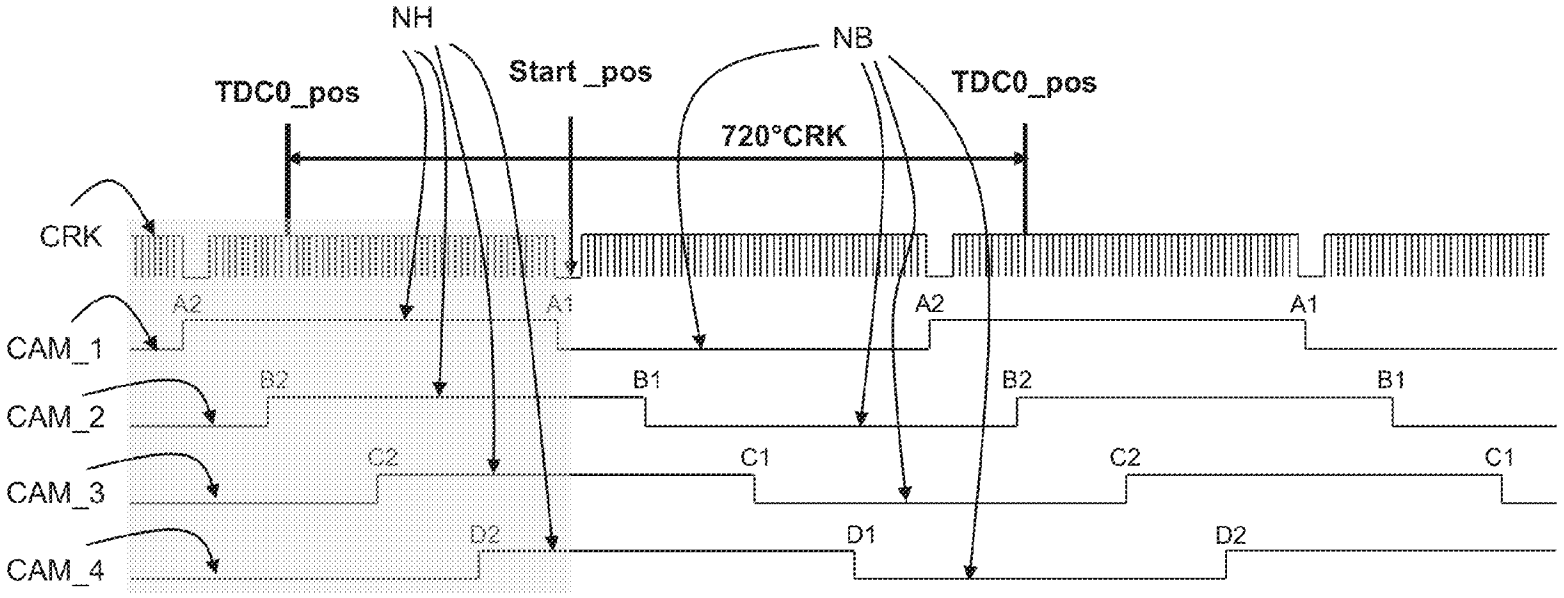
Figure 8:
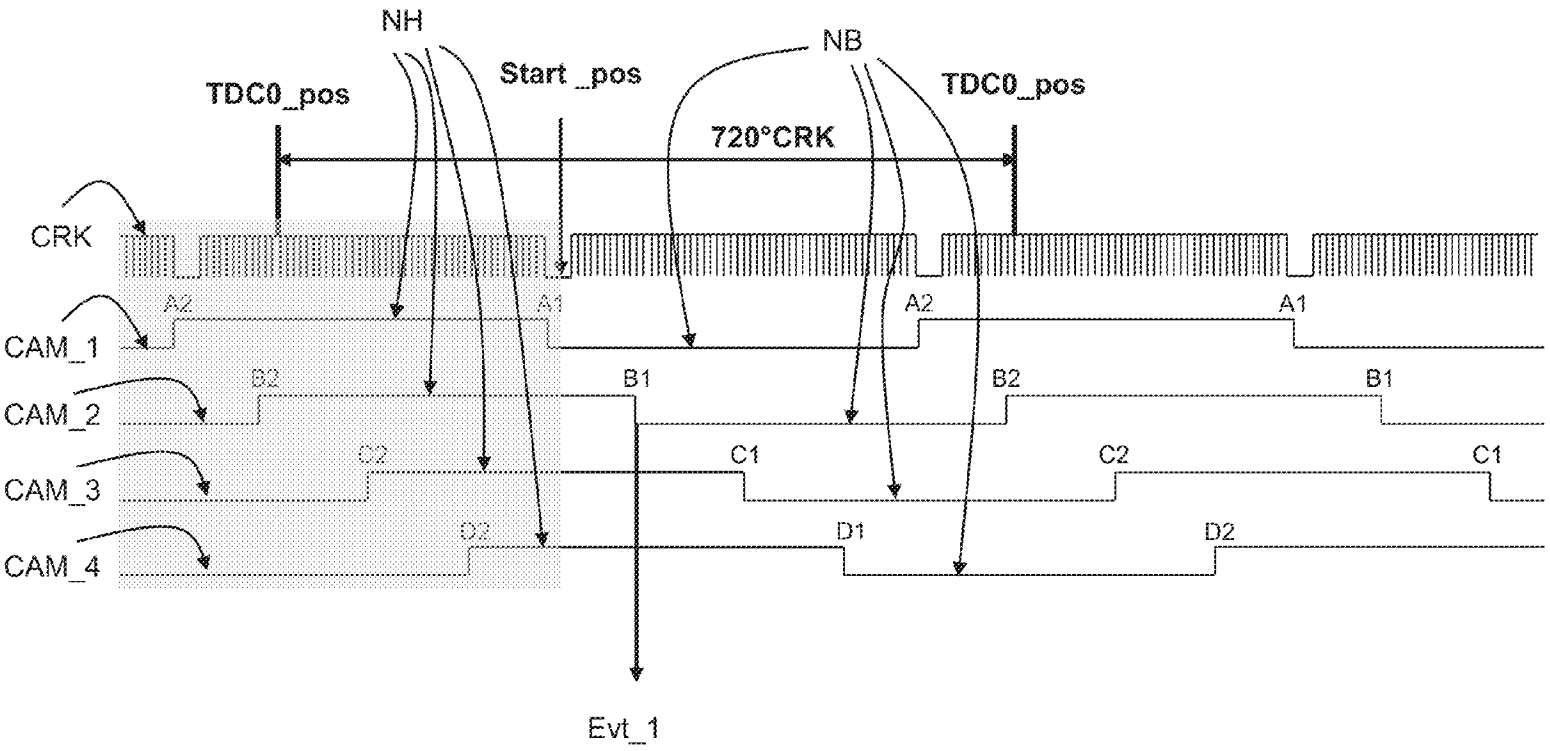
Figure 9:
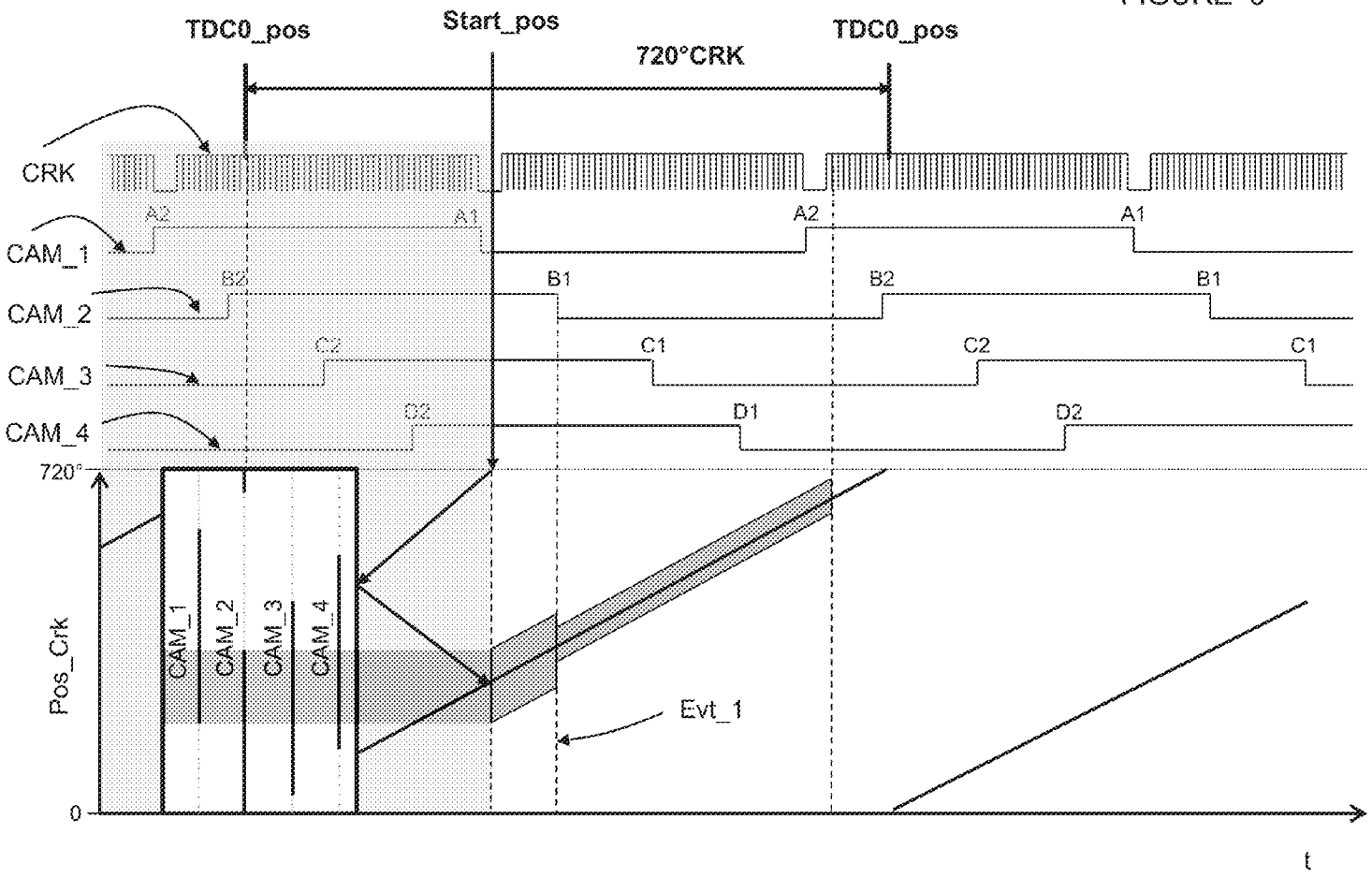
FIG. 9 is a schematic overview which combines FIGS. 7 and 8.

Each FIGS. 7 to 9 indicates, on five separate horizontal lines, as a development, the respective events constituting the camshaft targets CAM_1, CAM_2, CAM_3 and CAM_4, and the crankshaft target CRK. The events of the five targets are indicated in synchronization according to the vertical direction in each figure, as in the first example described above. The comparative principle of use of FIGS. 7 to 9 of the second example is identical to the comparative principle of use of FIGS. 1 to 6 relating to the first example.

In this second example, the target CRK is the same as that of the first example and is indicated in the same way. The camshaft targets CAM_1, CAM_2, CAM_3 and CAM_4 themselves each have two reading levels, a high level NH and a low level NB, these two levels being separated by two fronts, A1 and A2 for the target CAM_1, B1 and B2 for the target CAM_2, C1 and C2 for the target CAM_3, D1 and D2 for the target CAM_4, respectively, a rising front and a falling front as indicated. There are therefore two events of the front type per target CAM_i revolution for each camshaft.

In FIGS. 7 to 9, as in the first example, the starting position of the crankshaft at the time where it is set in rotation by means of an electric starter motor for example, has been indicated with a vertical reference index Start_pos. The assumption in this second example is that starting likewise occurs while the beam of the sensor of the target CRK is positioned in a reference tooth 1 of the target CRK. Therefore it is necessary to wait for at least one 360° rotation of the crankshaft before synchronization is completed, i.e. for the first reference tooth to appear, the starting one not being detected.

FIG. 7 gives the true position of the engine at the time the crankshaft begins to rotate, for a start with the beam of the sensor of the crankshaft target CRK positioned in the reference tooth 1.

At this stage of the start, given the two levels of the targets CAM_i, the first set of ranges of plausible positions of the crankshaft is as follows:

$$[A1,A2]\cap[B2,B1]\cap[C2,C1]\cap[D2,D1]+/-\text{Tolerances}$$

By correlating the targets CAM_i with one another, and following their profile and comparative arrangement recorded in the engine control unit, target CAM_1 being detected at the start of the low level NB and the other three targets CAM_2, CAM_3 and CAM_4 being detected at the high level NH, this first set can be reduced to the following single plausible set, from the start:

$$[A1,B1]+/-\text{Tolerances}$$

The range of plausible positions of the crankshaft between A1 and B1 represents an angular distance of the crankshaft of around 90°, give or take the detection tolerances. As a result, the estimation of the position of the crankshaft will already be sufficiently precise to allow pre-injection in an indirect injection engine.

The crankshaft is turned on by the starter, and FIG. 8 illustrates the detection of a first camshaft target event evt_1, from the setting-in-rotation of the crankshaft. This is the front B1 of the target CAM_1 in the example depicted, that the engine control unit can at this stage of identification recognize, given the set [A1, B1] already determined to within the detection tolerances.

As depicted in FIG. 8, after this first event evt_1 detected, there remains just one single plausible range of positions for the crankshaft, which is therefore theoretically B1 to within the detection tolerances. This single plausible range, bearing in mind the detection tolerances, in actual fact contains a set of plausible positions around the front B1, which positions represent the detection tolerances of the sensor of the target CAM_2, as shown in FIG. 9. Just one event from the start of rotation of the crankshaft will have been necessary in order to provide an estimate of the angular position of the crankshaft prior to synchronization of the engine. In FIG. 8, it is recalled that the synchronization of the engine could not take place until the reference tooth 1 of the target CRK had been detected for a first time following the setting-in-rotation of the crankshaft. Again in FIG. 8, it may be seen that there were still four events C1, D1 and A2 to be detected on the targets CAM_3, CAM_4 and CAM_1 respectively before this reference tooth 1 of the target CRK was detected.

FIG. 9 illustrates, for the second example, and in the same way as FIG. 6 in respect of the first example, the successive sets of ranges of plausible positions of the crankshaft prior to synchronization, in this example for each event detected, from the starting position Start_pos. By comparison with FIG. 6, respective ranges of plausible positions of the four camshaft targets have also been indicated in dark vertical lines on the ordinate axis in the lower part of the diagram that relates to the representation of the estimation of the position Pos_CRK of the crankshaft. The dark gray horizontal stripe indicates the smallest plausible range in common and for that purpose intercepts these four plausible ranges of targets CAM_i, with i taking values from 1 to 4. This dark gray horizontal stripe thus determines, by intersection, the width of the single range of plausible starting positions of the crankshaft, which corresponds to the start of the oblique dark gray stripe between the starting point and the first event evt_1 detected, as explained hereinbelow.

At the time of the starting position Start_pos, detection of the position of all the camshaft targets has therefore made it possible to reduce the set of ranges of plausible positions of the crankshaft to the angular distance comprised between the fronts A1 and B1 of the targets CAM_1 and CAM_2 respectively reduced to the corresponding crank angle given the relationship between the rotations of these two components (two revolutions of the crankshaft to one revolution of a camshaft), to within the detection tolerances. This single range of plausible positions is indicated in FIG. 9 by an oblique dark gray stripe of a width equivalent to this angular distance [A1,B1] comprised in the diagram at the bottom of the figure between the starting point Star pos and the first event evt_1 on the abscissa time axis.

Onwards of the first event evt_1 detected in this second example, the set of ranges of plausible positions of the crankshaft prior to synchronization has been reduced to the event B1 as explained in detail above, and this is illustrated in FIG. 9 by a narrower oblique stripe, starting from the event evt_1. The width of the oblique stripe after the event detected and identified as the front B1 is due to the tolerances on the detection of the event B1. The stripe ends at the end of synchronization of the engine as the reference tooth 1 goes past.

In FIG. 9 it may be seen that a single range of estimated position of the crankshaft has been obtained with a precision of the order of plus or minus 20° crank angle, after 90° following the setting-in-rotation of the crankshaft. Pre-injection can therefore be performed after these 90 degrees of rotation following the setting-in-rotation of the crankshaft, allowing this pre-injection to be anticipated by an angular distance of the order of 360°, namely around 300 milliseconds.

A method for estimating the position of a crankshaft prior to synchronization as described above can be executed by software implemented in an engine control unit of known type in a vehicle with a view to providing an additional function in addition to the synchronization function already present in the engine control unit, for example in order to perform pre-injection prior to synchronization. The engine control unit thus implemented combined with the crankshaft and camshaft targets, constitutes one example of a device for estimating the angular position of a crankshaft of a 4-stroke internal combustion engine prior to synchronization of the engine, comprising the means necessary for implementing a method for estimating the position of a crankshaft prior to synchronization, as described.

The invention claimed is:

1. A method, to be executed by a computer device, for estimating the angular position of a crankshaft of a 4-stroke internal combustion engine prior to synchronization of the engine, said engine comprising at least one cylinder comprising a piston configured to move between a top dead center and a bottom dead center, the movement of the piston driving the crankshaft and a plurality of camshafts provided with a number n of targets (CAM_i) secured respectively to n camshafts of said plurality of camshafts, each target defining a plurality of events over one revolution of the camshaft to which the target is secured, the crankshaft being provided with a securely-attached target (CRK) comprising a plurality of standard teeth and at least one reference tooth which define a plurality of events over one crankshaft revolution, the estimating method comprising:

determining a precision to be achieved in estimating a range of plausible positions (Pos_Crk) of the crankshaft prior to synchronization, then estimating a range of plausible positions (Pos_Crk) of the crankshaft prior to synchronization, at a given moment, from events detected on said n camshaft targets, correlated with events detected on the crankshaft target, as corresponding to the shortest angular window that is common to all the members of rank i using the following formula:

$$\text{Pos_Crk_est} = \bigcap_{i=1}^{i=n_CAM} \text{List_event_plaus_CAM_i} + \text{Dist_ang_CRK_since_last_event_CAM_i} + \text{Tolerances_i}$$

where:

Pos_Crk_est = range of plausible positions of the crankshaft at the given moment, List_event_plaus_CAM_i = all of the plausible events of the rank i camshaft target (CAM_i) at the given moment, Dist_ang_CRK_since_last_event_CAM_i=angular distance covered by the crankshaft, determined by all of the detected events of the crankshaft target (CRK) since the last event detected on the rank i camshaft target (CAM_i), at the given moment, Tolerances_i = angular window of possible positions of the crankshaft, resulting from the angular tolerance on the detection of an event on the rank i camshaft target (CAM_i) and the crankshaft target (CRK), and n_CAM = number of camshaft targets (CAM_i) used in the engine; and repeating said estimate of a range of plausible positions of the crankshaft prior to synchronization, at a later moment, until said precision that is to be achieved in estimating a range of plausible positions of the crankshaft prior to synchronization is obtained.

2. The method as claimed in claim 1, wherein the movement of the piston drives the crankshaft and at least one first and one second camshaft which are respectively provided with a first securely attached target (CAM_1) and a second securely attached target (CAM_2), the method further comprising the following steps:

at a first event (evt_1) detected on one of the first (CAM_1) and second (CAM_2) camshaft targets, recording the events detected on the crankshaft target (CRK) from the setting-in-rotation thereof, defining a first correlation (CAM_i-CRK1) assigned to said first event, eliminating the events on said one of the first (CAM_1) and second (CAM_2) camshaft targets which from the first correlation (CAM_i-CRK1) cannot be plausible, and determining a first set of ranges of plausible positions of the crankshaft as being made up of a first set of events that remain plausible on said one of the first (CAM_1) and second (CAM_2) camshaft targets at the end of the first event detected, at a second event (evt_2), subsequent to the first event (evt_1), detected on one of the first (CAM_1) and second (CAM_2) camshaft targets, recording the events detected on the crankshaft target (CRK) between said first (evt_1) and second (evt_2) events detected, defining a second correlation (CAM_i-CRK2) assigned to said second event, eliminating the events on said one of the first (CAM_1) and second (CAM_2) camshaft targets which from said second correlation (CAM_i-CRK2) cannot be plausible, and determining a second set of ranges of plausible positions of the crankshaft as being made up of a second set of events that remain plausible on said one of the first (CAM_1) and second (CAM_2) camshaft targets at the end of the second event (evt_2) detected, determining a third set of ranges of plausible positions of the crankshaft as being made up of the ranges of plausible positions that are common to said first and second sets of events that remain plausible on the first (CAM_1) and/or second (CAM_2) camshaft targets at the end of the first (evt_1) and second (evt_2) events detected, determining a fourth set of ranges of plausible positions of the crankshaft as being made up of said third set of ranges of plausible positions of the crankshaft from which have been eliminated those positions that are not plausible at the end of a first correlation (CAM_i-CAM_i1) between, on the one hand, said first (evt_1) and second (evt_2) events detected on one and/or the other of the camshaft targets and, on the other hand, the angular distance given by the events detected on the target (CRK) between these said first (evt_1) and second (evt_2) events detected on one and/or the other of the camshaft targets (CAM_i), and repeating the preceding steps until an nth set of ranges of plausible positions of the crankshaft containing a single plausible range of crankshaft positions (Pos_Crk) is obtained.

3. The method as claimed in claim 2, further comprising determining an intermediate set of ranges of plausible positions of the crankshaft, at a current position thereof, between two successive events of the first (CAM_1) and/or second (CAM_2) camshaft targets, from a correlation (CAM_i-CRK3) between the last event detected on one of the camshaft targets (CAM_1, CAM_2) and said current position of the crankshaft, taking into consideration the crankshaft target (CRK) events detected between said last event and said current position of the crankshaft.

4. The method as claimed in claim 1, wherein said plurality of events for a target (CAM_i) which is determined over one revolution of a camshaft takes into account a selective parameter of distance to the axis of the target, for a surface connecting two successive distinct fronts of the target.

5. The method as claimed in claim 4, wherein a record is made of the situation of the n camshaft targets (CAM_i) at the time the crankshaft is set in rotation.

6. A method for the accelerated starting of an internal combustion engine, the method comprising:

the method of estimating the angular position of a crankshaft of a 4-stroke internal combustion engine prior to synchronization of the engine as claimed in claim 1; and after the precision is obtained in the angular position estimating method, injecting fuel before synchronization is complete.

7. A device for estimating the angular position of a crankshaft of a 4-stroke internal combustion engine prior to synchronization of the engine, said engine comprising at least one cylinder comprising a piston that can move between a top dead center and a bottom dead center, the movement of the piston driving the crankshaft and a plurality of camshafts, the device comprising:

a number n of targets (CAM_i) respectively secured to n camshafts of said plurality of camshafts, each target defining a plurality of events over one revolution of the camshaft to which the target is secured;

a target (CRK) secured to the crankshaft, comprising a plurality of standard teeth and at least one reference tooth which define a plurality of events over one crankshaft revolution; and an engine control unit configured to implement the method as claimed in claim 1.

8. The device as claimed in claim 7, further comprising fuel injection means, wherein the engine control unit further comprises an accelerated starting system configured to cause accelerated starting of an internal combustion engine including injecting the fuel before synchronization is complete.

9. The method as claimed in claim 2, wherein said plurality of events for a target (CAM_i) which is determined over one revolution of a camshaft takes into account a selective parameter of distance to the axis of the target, for a surface connecting two successive distinct fronts of the target.

10. The method as claimed in claim 3, wherein said plurality of events for a target (CAM_i) which is determined over one revolution of a camshaft takes into account a selective parameter of distance to the axis of the target, for a surface connecting two successive distinct fronts of the target.

11. The method as claimed in claim 9, wherein a record is made of the situation of the n camshaft targets (CAM_i) at the time the crankshaft is set in rotation.

12. The method as claimed in claim 10, wherein a record is made of the situation of the n camshaft targets (CAM_i) at the time the crankshaft is set in rotation.

13. A method for the accelerated starting of an internal combustion engine, the method comprising:

the method of estimating the angular position of a crankshaft of a 4-stroke internal combustion engine prior to synchronization of the engine as claimed in claim 2; and after the precision is obtained in the angular position estimating method, injecting fuel before synchronization is complete.

14. A method for the accelerated starting of an internal combustion engine, the method comprising:

the method of estimating the angular position of a crankshaft of a 4-stroke internal combustion engine prior to synchronization of the engine as claimed in claim 3; and after the precision is obtained in the angular position estimating method, injecting fuel before synchronization is complete.

15. A method for the accelerated starting of an internal combustion engine, the method comprising:

the method of estimating the angular position of a crankshaft of a 4-stroke internal combustion engine prior to synchronization of the engine as claimed in claim 4; and after the precision is obtained in the angular position estimating method, injecting fuel before synchronization is complete.

16. A method for the accelerated starting of an internal combustion engine, the method comprising:

the method of estimating the angular position of a crankshaft of a 4-stroke internal combustion engine prior to synchronization of the engine as claimed in claim 5; and after the precision is obtained in the angular position estimating method, injecting fuel before synchronization is complete.

* * * * *